United States Patent [19]

Smedal

[11] 4,369,538

[45] Jan. 25, 1983

[54] APPARATUS FOR TRANSFER OF PERSONS AND GOODS BETWEEN STRUCTURES OFFSHORE

[76] Inventor: Arne Smedal, Torjusholmen, 4818 Pusnes, Norway

[21] Appl. No.: 126,575

[22] Filed: Mar. 3, 1980

[51] Int. Cl.[3] ..... E01D 1/00

[52] U.S. Cl. ..... 14/69.5; 414/141; 182/10; 182/141; 182/2; 14/71.5

[58] Field of Search ..... 14/71.1, 71.5, 69.5, 14/71.7; 414/139, 141; 114/230; 182/10, 2, 130, 141

[56] References Cited

U.S. PATENT DOCUMENTS

| | | | |
|---|---|---|---|
| 3,047,891 | 8/1962 | Golde | 14/71.5 |
| 3,145,854 | 8/1964 | Sturm | 14/71.1 X |
| 3,426,719 | 2/1969 | Mizell | 14/71.1 X |
| 3,541,626 | 11/1970 | Eggert | 14/71.5 X |
| 3,816,867 | 6/1974 | Shirzad | 14/71.5 |
| 4,003,473 | 1/1977 | Ryan | 14/71.1 X |
| 4,011,615 | 3/1977 | Maxson | 14/71.1 |
| 4,035,861 | 7/1977 | Edge | 14/71.1 |
| 4,112,958 | 9/1978 | Anderberg | 14/71.5 X |
| 4,133,283 | 1/1979 | Ryan | 14/71.1 X |
| 4,157,742 | 6/1979 | Aanensen | 14/71.1 X |
| 4,203,504 | 5/1980 | Reynoir | 182/10 |

*Primary Examiner*—Nile C. Byers, Jr.

*Attorney, Agent, or Firm*—Cushman, Darby & Cushman

[57] ABSTRACT

System for offshore transfer of persons and goods, preferably between a supply vessel and a stationary platform or a moored drilling/production platform or vessel, comprising a rigid gangway of which one end is pivotable on a vertical and a horizontal axis arranged on a vessel. The second end of the rigid gangway having a transition to one end of a collapsible bellowshaped gangway where changes of the total length is approximately equalized between the various elements, while the second end of the gangway can be fixed to the vessel. When the bellow-shaped gangway is in use it is supported by ropes, rods or similar means. Each support is fastened at one end and the second end is fastened to a winch which can compensate for changes in the line tension when the fixing points are moving relative to each other.

5 Claims, 7 Drawing Figures

APPARATUS FOR TRANSFER OF PERSONS AND GOODS BETWEEN STRUCTURES OFFSHORE

The invention herein described relates to a system for offshore transfer of persons and goods, preferable between a supply vessel and a fixed/moored structure, comprising a flexible, long extended body rotatably arranged on one of the structures and with its free end transferable to the other structure at a distance from the first structure.

It is known and used different methods for personnel-transfer between structures offshore and with special reference to transfer of personnel from transfer vessels designed for high speed and safety during the transportation phase from a shore base to the platforms offshore.

Even in good weather swells occur making it difficult to establish a safe connection for personnel transfer from the transfer vessel to the platform. The difficulties increase with increasing wind force and waves.

One of the most known and used transfer system comprises a line fixed to the two structures. On the line a transverse carriage is arranged, carrying a personnel basket or a cabin to be pulled to and from the structures by a pulling rope connected to winches at one of the structures or with winches at both structures.

Another transfer method is using a crane fixed to a basket or a cabin which can be lowered down to the transfer vessel where the personnel can enter or leave the basket.

The problem with this method is difficulties to land the cabin safely on the transfer vessel, exposed to environmental loads, introducing relative motions between the cabin and transfer vessel.

Obviously there are different methods for registration of the wavemotions of the vessel and based on signals from such equipment calculate the vessel's motions and guide the crane winches to compensate for the motion of the cabin during lowering or heaving. Such equipment is relatively complicated and expensive. The purpose of the invention herein described is to provide a system for personnel and goods based on relatively simple mechanical components avoiding use of sophisticated equipment, as described above, and when the connection between the structures is done in a more or less known way and where the personnel, when connection is established, has to move by themselves from the one structure to the other.

This is attained according to the invention outlined in the enclosed claims.

FIG. 1 is a side elevational view of a transfer system embodying the principles of the present invention;

FIGS. *2a, 2b, 2c* and *2d* are schematic side elevational views of the system of FIG. 1, illustrating various positions taken by the components during wave action;

The mode of operation for the transfer system according to the invention considered is shown in enclosed FIGS. *2a–d*. The figure shows the interaction between the bellowshaped, long extended body, with supporting lines and the transfer vessel, moving in the waves, and the fixed structure. Obviously the fixed structure may be a moored semisubmersible rig or any type resting on the seabottom with one or more legs.

Figure 1:
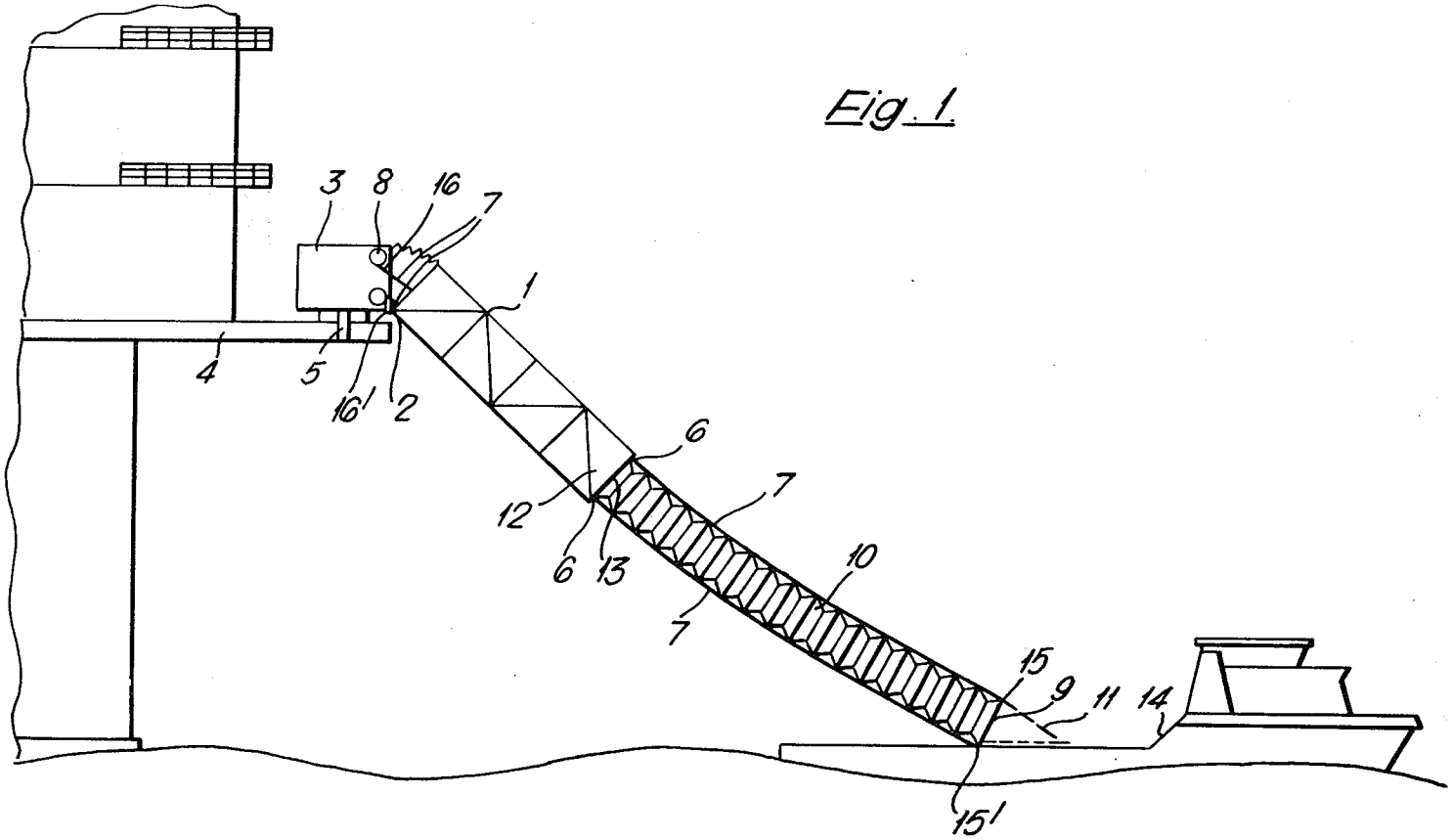
Figure 2A:
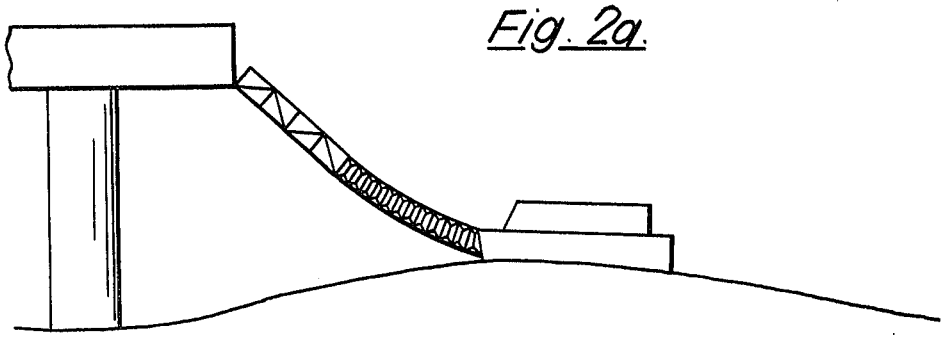
Figure 2B:
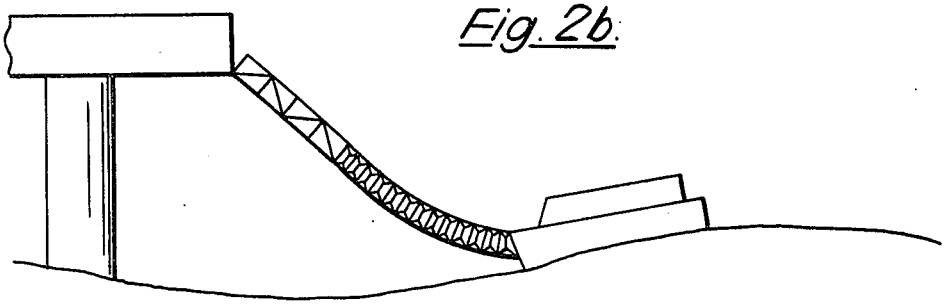
Figure 2C:
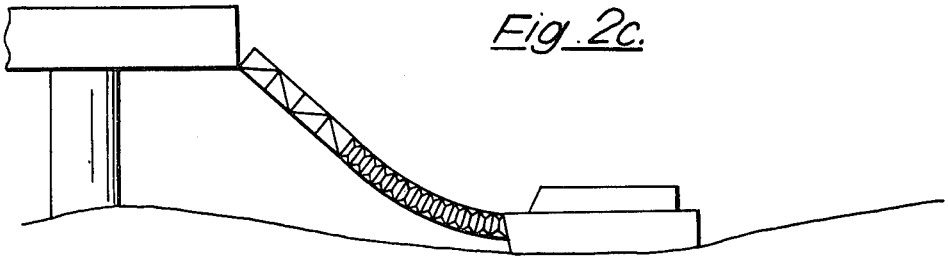
Figure 2D:
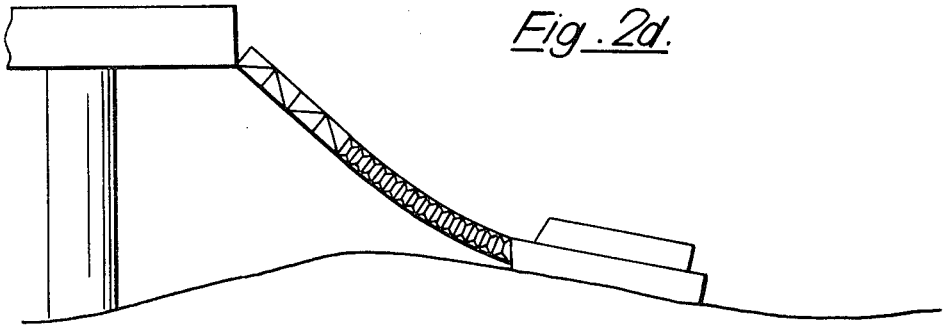

Particulars of the invention is shown on enclosed FIG. 1, and comprises a rigid gangway 1 hinged at 2 to a base 3 rotatable on the platform 4 by the support bearings 5, on a vertical axis.

The rigid gangway, preferable square shaped, comprises guide devices 6 for the supporting lines 7 at their ends 16, 16' connected to winches 8 arranged on the base 3 or on the rigid structure 1. At the other ends 15, 15' of the supporting lines 7, a frame 9 is connected. From the end 12 of the rigid gangway the end 13 of a collapsible bellows 10 is connected. The collapsible bellows 10 is supported by the lines 7 in operation condition and fixed to the frame 9 at 15, 15'. In stowed position the bellows 10, the supporting lines and the frame 9 are retracted in the rigid gangway 1 and the gangway itself is stowed in a horizontal position on the platform deck. The frame 9 and the supporting lines are connected to a pulling line 11 to be transferred to the transfer vessel 14 by a pick-up line connected to a buoy, or the line 11 is shot to the transfer vessel 14 in a known way. The transfer vessel 14 is positioned at a reasonable distance from the platform, for example 30–50 m and pulls in the line 11, the frame 9 and the supporting lines 7. When connection is established the collapsible bellows 10 containing a walkway can be brought on the supporting lines 7 over to the transfer vessel 14. The collapsible bellows 10 and supporting lines can also be brought into position in one operation. The transfer vessel 14 keeps a reasonable tension in the supporting lines 7 to establish more or less a catenary curve in the lines 7 and the bellows 10. The personnel may now walk from the transfer vessel 14 to the platform 4 and vice versa on a walkway formed in the bottom of the bellows 10, the bottom being equipped with antisliding coating or steps.

Due to the flexibility of the transfer system the transfer vessel 14 is allowed to move relative to the platform 4 in a way that avoids extreme loads in the lines 7 or the bellows 10. A change in the total length of the bellows 10 is approximately equalized between the various bellows elements.

The winches 8 may be of the so called mooring winches, maintaining a constant tension in the lines 7 and the lines 7 may also be connected to motion compensating cylinders, springs or elastic line, which can give and take the line length depending on the tension in the lines 7 caused by the motions of the transfer vessel 14.

When a transfer operation is completed the bellows 10 and the lines 7 with frame 9 are retracted to the rigid gangway and stowed away until the next operation.

The complete transfer system may be placed on movable means along the platform deck to cover two or more edges of the platform or moved by crane to cover a greater operating area around the platform.

The fixed gangway may be telescopic and outstretched in the operating phase connected to the collapsible gangway 10 forming the transfer system for the personnel.

In the shown example on FIG. 1 the bellows 10 with its end 13 is connected to the rigid gangway at 12. The bellows 10 may also with its end 13 be connected to the opposite end of the rigid gangway, to increase the effective length of the collapsible gangway.

Figure 3:
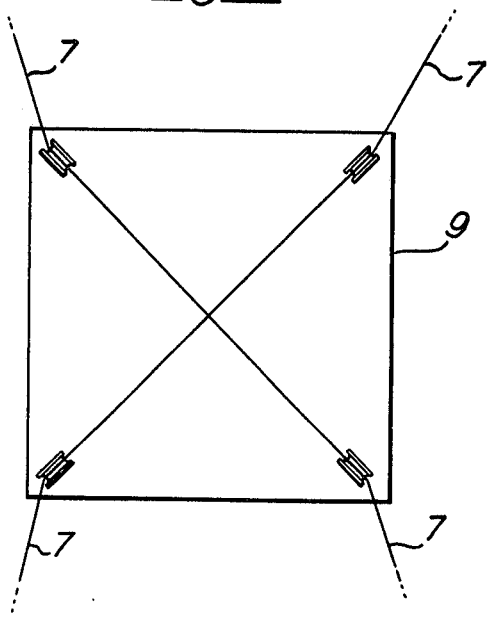
FIG. 3 is a view of a tension-balanced frame for the supporting lines.
Figure 4:
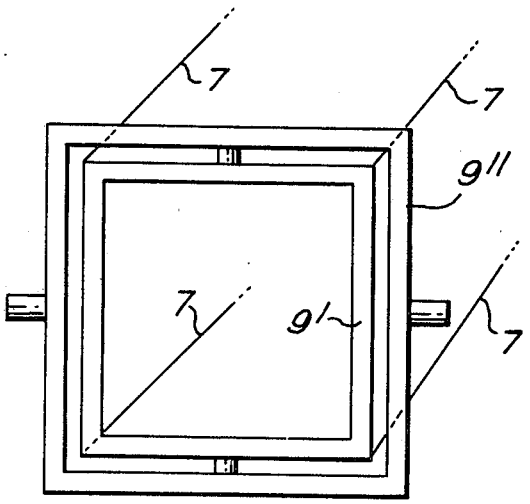
FIG. 4 is a plan view of an alternative form of frame.

The supporting lines 7 may alternatively be connected to a tension balancing means between the lines 7 by two and two diagonal supporting lines being connected over pulleys which are arranged in frame 9, or the supporting lines 7 are connected to a frame which is suspended in a universal joint 9′, 9″ shown in FIGS. 3 and 4, respectively.

Having described my invention, I claim:

1. Apparatus for offshore transfer of persons and goods, preferably between a supply vessel and a fixed platform or a moored drilling/production platform or vessel, comprising a rigid gangway of which one end is pivotably suspended on a vertical and a horizontal axis arranged on a vessel, the second end of the rigid gangway having a transition to one end of a longitudinally extensible and retractable bellowshaped gangway where changes of the total length is approximately equalized between the various bellows elements, the second end of the bellowshaped gangway being attachable to a vessel, and the bellowshaped gangway when it is in use being supported by at least one elongated flexible supporting member maintained in tension within predetermined limits, said member being fixed at one end and having an opposite end connected to a tension adjusting winch controlled by signals from a sensor which is responsive to the tension in said member.

2. Apparatus for offshore transfer of person between a floating vessel and an offshore structure which is fixed relative to the water comprising: a rigid gangway assembly pivoted at one end to the fixed structure for swinging movement about horizontal and vertical axes; a longitudinally extensible and retractable bellows-like gangway connected at one end to the other end of said rigid gangway, said gangway being flexible about horizontal axes so as to be capable of assuming a range of curved configurations; at least one elongated flexible supporting member extending the length of said bellows-like gangway and connected thereto along its length for supporting the weight of said gangway, one end of said supporting member being supported by said fixed structure and the other end being attachable to the floating vessel whereby said supporting member can be placed in tension when said other end is attached to the floating vessel.

3. Apparatus as in claim 2 including means for adjusting the tension in said support member when attached to the floating vessel to maintain a generally constant tension in said support member.

4. Apparatus as in claim 2 wherein said one end of said elongated flexible supporting member is attached to a tension-adjusting winch secured to said fixed structure.

5. Apparatus as in claim 2 wherein said bellows-like gangway and said rigid gangway are hollow, the cross-section of said rigid gangway being greater than the cross-section of said bellows-shaped gangway and wherein said bellows-like gangway is retractable into said rigid gangway for storage so that said rigid gangway substantially encircles said bellows-shaped gangway.

* * * * *